US012766584B2

(12) United States Patent
Peng

(10) Patent No.: US 12,766,584 B2
(45) Date of Patent: Oct. 20, 2026

(54) DIAMETER-EXPANDING TOOL HEAD AND DIAMETER-EXPANDING METHOD THEREOF

(71) Applicant: Cheng-Chia Peng, Taichung City (TW)

(72) Inventor: Cheng-Chia Peng, Taichung City (TW)

( * ) Notice: Subject to any disclaimer, the term of this patent is extended or adjusted under 35 U.S.C. 154(b) by 322 days.

(21) Appl. No.: 18/452,186

(22) Filed: Aug. 18, 2023

(65) Prior Publication Data

US 2024/0066584 A1 Feb. 29, 2024

(30) Foreign Application Priority Data

Aug. 23, 2022 (TW) ..... 111131749

(51) Int. Cl.
*B21D 41/02* (2006.01)

(52) U.S. Cl.
CPC ..... *B21D 41/021* (2013.01)

(58) Field of Classification Search
CPC ..... Y10T 29/49911; Y10T 29/4994; B21D 39/06; B21D 39/046; B21D 39/20; B21D 41/026; B21D 41/021; F16L 33/213; F16L 13/147; B29C 57/04
USPC ..... 29/243.518, 523, 507, 890.044; 72/479, 72/370.06
See application file for complete search history.

(56) References Cited

U.S. PATENT DOCUMENTS 1,759,224 A * 5/1930 Burns ..... B21K 1/16 29/507
3,665,591 A * 5/1972 Kowal ..... F16L 33/213 29/523
3,812,704 A * 5/1974 Kowal ..... B21D 39/00 72/476
5,564,184 A * 10/1996 Dinh ..... B21D 53/085 29/890.044
2019/0351605 A1* 11/2019 Trickle ..... B29D 23/003

FOREIGN PATENT DOCUMENTS

TW 202144682 A * 12/2021 ..... F16B 25/0015
WO WO-2014176506 A1 * 10/2014 ..... F16L 33/20

OTHER PUBLICATIONS

Translation of TW-202144682.*

* cited by examiner

*Primary Examiner* — Bobby Yeonjin Kim
(74) *Attorney, Agent, or Firm* — Best & Flanagan LLP

(57) ABSTRACT

A diameter-expanding tool head and a diameter-expanding method thereof, the tool head comprises an expanding section forming convex portions and concave portions disposed at intervals on an outer peripheral surface, any one of the concave portions is formed between any two of the convex portions, each of the convex portions has a convex peak, the convex peak is a part farthest from an axis, each distance is equal, the convex peaks are connected to form a diameter-expanding surface spanning each of the concave portions. The expanding section is rotatably inserted into a channel of a body to be expanded, and is in discontinuous contact with the channel through the convex and concave portions, a diameter of at least a part of the body to be expanded is expanded to form a diameter-expanded channel, and an inner wall surface of the diameter-expanded channel is flush with the diameter-expanding surface.

6 Claims, 9 Drawing Sheets

DIAMETER-EXPANDING TOOL HEAD AND DIAMETER-EXPANDING METHOD THEREOF

FIELD OF THE INVENTION

The invention relates to a diameter-expanding tool head and a diameter-expanding method thereof in a discontinuous contact mode.

BACKGROUND OF THE INVENTION

Generally, diameter expansion requires the diameter-expanding tool head to match the body to be expanded, wherein the body to be expanded has a channel. Usually, the outer diameter of the diameter-expanding tool head is larger than the inner diameter of the channel of the body to be expanded, and the hardness of the diameter-expanding tool head is higher than the hardness of the body to be expanded. Thereby, the diameter-expanding tool head is gradually inserted into the channel of the body to be expanded to perform diameter expansion.

At this time, both the diameter-expanding tool head and the body to be expanded are in continuous surface-to-surface contact for diameter expansion. As the contact area between the two becomes larger, the load of the diameter-expanding tool head on the body to be expanded will increase accordingly. In addition, the heat accumulated between the diameter-expanding tool head and the body to be expanded during the friction process causes the temperature to rise, which not only causes changes of morphology of the friction surfaces, but also causes the material to undergo phase change, which changes its material strength, and even affects its service life.

SUMMARY OF THE INVENTION

An object of the invention is to provide a diameter-expanding tool head and a diameter-expanding method thereof to solve the above difficulties mentioned in the prior art.

In one embodiment of the invention, a diameter-expanding tool head is provided. The diameter-expanding tool head defining an axis, the diameter-expanding tool head defining a front end and a rear end relative to the axis, the diameter-expanding tool head comprises an expanding section and a blocking section. The expanding section being formed from the front end toward the rear end relative to the axis, the expanding section being formed with an outer peripheral surface relative to the axis, the outer peripheral surface being formed with a plurality of convex portions and a plurality of concave portions disposed at intervals, any one of the concave portions being formed between any two of the convex portions, each of the convex portions having a convex peak, the convex peak of each of the convex portions being a part farthest from the axis, each distance being equal, a maximum outer diameter of the expanding section being located at any one of the convex peaks, the convex peak of each of the convex portions being axially connected relative to the axis to form a diameter-expanding surface, the diameter-expanding surface spanning each of the concave portions. The blocking section connected to the expanding section, the blocking section being formed on the rear end relative to the axis, an outer diameter of the blocking section being larger than the maximum outer diameter of the expanding section, and a connection between one side surface of the blocking section and the expanding section radially forming a blocking surface relative to the axis.

In one embodiment of the invention, a diameter-expanding tool head is provided. The diameter-expanding tool head defining an axis, the diameter-expanding tool head defining a front end and a rear end relative to the axis, the diameter-expanding tool head comprises an expanding section and a blocking section. The expanding section being formed from the front end toward the rear end relative to the axis, the expanding section being formed with an outer peripheral surface relative to the axis, the outer peripheral surface being formed with two surfaces opposite to each other, the two opposite surfaces defining two opposite side surfaces, the expanding section forming a plurality of convex portions and a plurality of concave portions at intervals on each of the side surfaces relative to the axis, any one of the concave portions being formed between any two of the convex portions, each of the convex portions having a convex peak, the convex peak of each of the convex portions being a part farthest from the axis, each distance being equal, a maximum outer diameter of the expanding section being located at any one of the convex peaks, the convex peak of each of the convex portions being axially connected relative to the axis to form a diameter-expanding surface, the diameter-expanding surface spanning each of the concave portions. The blocking section connected to the expanding section, the blocking section being formed on the rear end relative to the axis, an outer diameter of the blocking section being larger than the maximum outer diameter of the expanding section, and a connection between one side surface of the blocking section and the expanding section radially forming a blocking surface relative to the axis.

In one embodiment of the invention, a diameter-expanding tool head is provided. The diameter-expanding tool head defining an axis, the diameter-expanding tool head defining a front end and a rear end relative to the axis, the diameter-expanding tool head comprises two expanding sections and a blocking section. The two expanding sections being formed relative to the axis, each of the two expanding sections being formed with an outer peripheral surface relative to the axis, the outer peripheral surface being formed with a plurality of convex portions and a plurality of concave portions disposed at intervals, any one of the concave portions being formed between any two of the convex portions, each of the convex portions having a convex peak, the convex peak of each of the convex portions being a part farthest from the axis, each distance being equal, a maximum outer diameter of each of the two expanding sections being located at any one of the convex peaks, the convex peak of each of the convex portions being axially connected relative to the axis to form a diameter-expanding surface, the diameter-expanding surface spanning each of the concave portions. The blocking section connected to the two expanding sections, a connection between two side surfaces of the blocking section and the two expanding sections radially forming a blocking surface relative to the axis, the blocking section being located between the two expanding sections, the front end of the diameter-expanding tool head being located at an end of one of the two expanding sections away from the blocking section, the rear end of the diameter-expanding tool head being located at an end of the other expanding section away from the blocking section, and an outer diameter of the blocking section being larger than the maximum outer diameters of the two expanding sections.

Numerous objects, features and advantages of the invention will be readily apparent upon a reading of the following detailed description of embodiments of the invention when taken in conjunction with the accompanying drawings. However, the drawings employed herein are for the purpose of descriptions and should not be regarded as limiting.

BRIEF DESCRIPTION OF THE DRAWINGS

The above objects and advantages of the invention will become more readily apparent to those ordinarily skilled in the art after reviewing the following detailed description and accompanying drawings, in which.

DETAILED DESCRIPTION OF THE PREFERRED EMBODIMENTS

Figure 1:
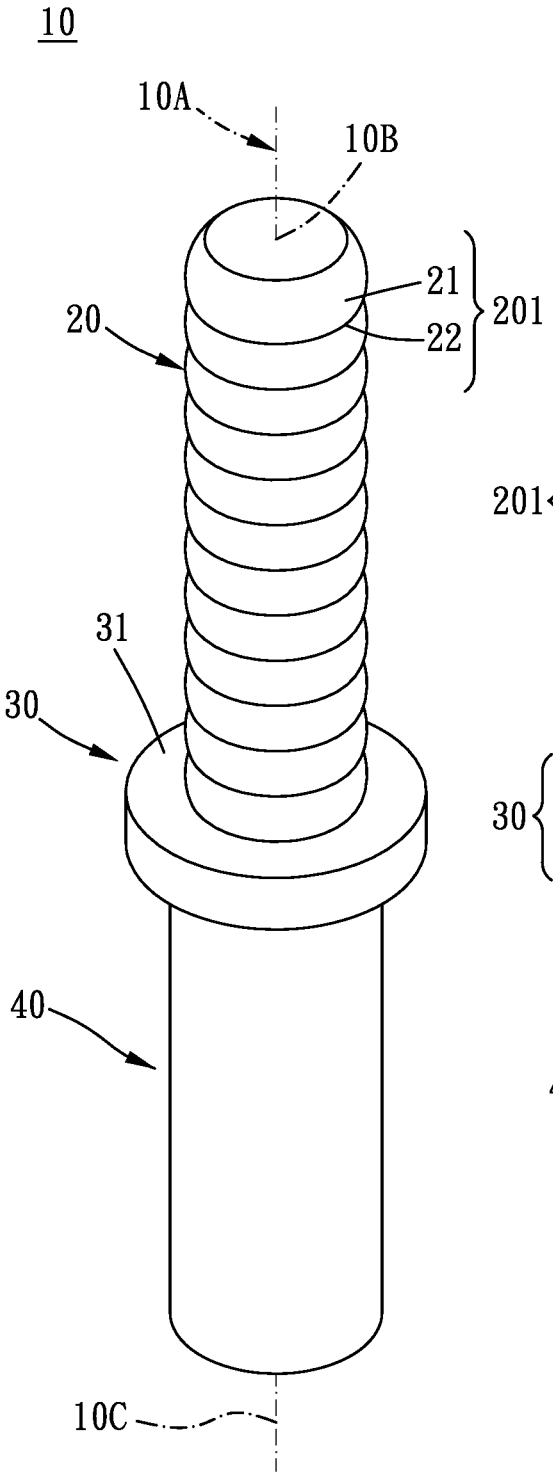
FIG. 1 is a first perspective view of a diameter-expanding tool head of the invention.
Figure 2:
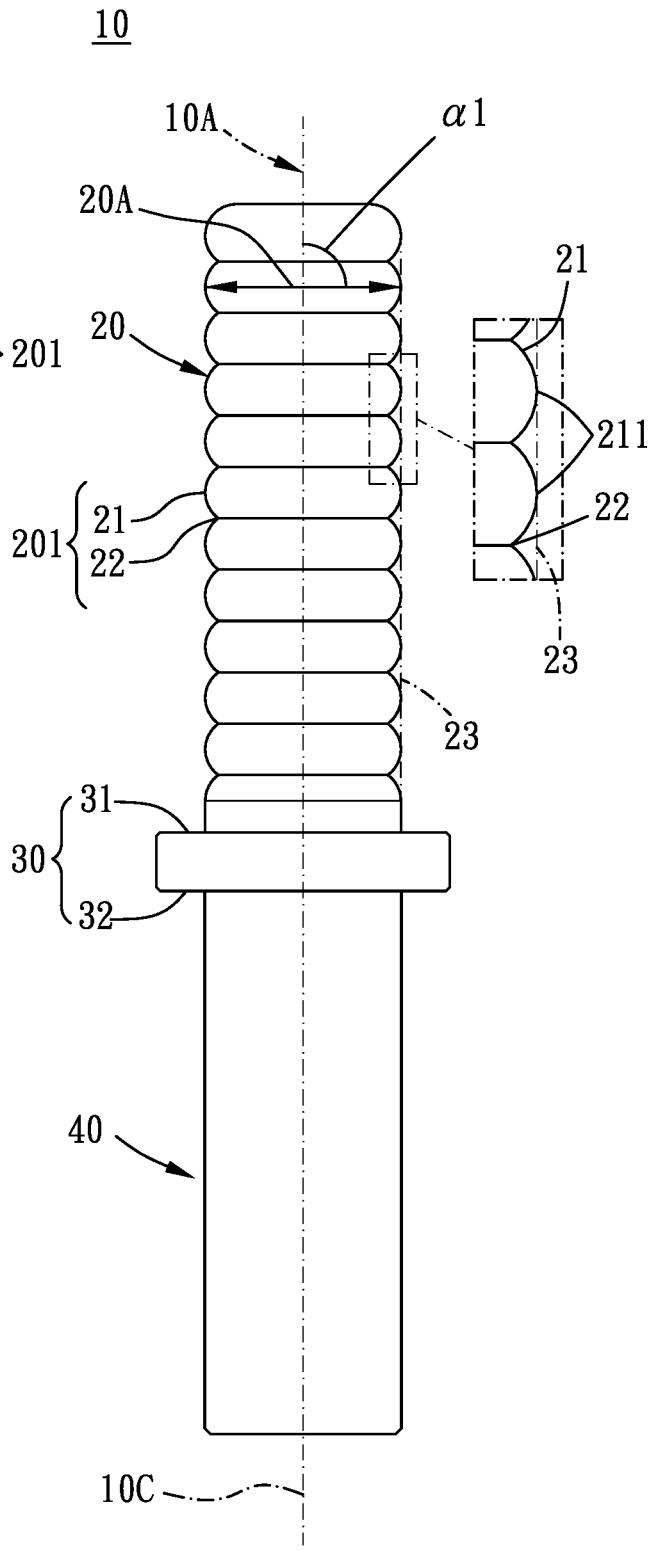
FIG. 2 is a plan view of the diameter-expanding tool head of FIG. 1 of the invention.

Please refer to FIG. 1 and FIG. 2, the invention provides a diameter-expanding tool head 10, the diameter-expanding tool head 10 defines an axis 10A, the diameter-expanding tool head 10 defines a front end 10B and a rear end 10C relative to the axis 10A, and the diameter-expanding tool head 10 comprises an expanding section 20 and a blocking section 30 connected to the expanding section 20 relative to the axis 10A.

The expanding section 20 adopts two embodiments and is described as follows.

In a first embodiment of the invention, the expanding section 20 is formed from the front end 10B toward the rear end 10C relative to the axis 10A, and the expanding section 20 is cylindrical. The expanding section 20 is formed with an outer peripheral surface 201 relative to the axis 10A. The outer peripheral surface 201 is a cylindrical surface, and the outer peripheral surface 201 is formed with a plurality of convex portions 21 and a plurality of concave portions 22 disposed at intervals. Any one of the concave portions 22 is formed between any two of the convex portions 21. Each of the convex portions 21 and each of the concave portions 22 do not intersect with each of the convex portions 21 and each of the concave portions 22, in particular, each of the convex portions 21 and each of the concave portions 22 are preferably parallel to each of the convex portions 21 and each of the concave portions 22.

Moreover, each of the convex portions 21 and each of the concave portions 22 have the following two forming modes, but are not limited to these two modes.

In the first forming mode (please refer to FIGS. 1 and 2), each of the convex portions 21 and each of the concave portions 22 are horizontally annularly disposed on the outer peripheral surface 201 of the expanding section 20 from the front end 10B toward the rear end 10C of the diameter-expanding tool head 10 to form a horizontal extending direction 20A, the horizontal extending direction 20A is parallel to the convex portions 21 and the concave portions 22 respectively, an included angle $\alpha 1$ is formed between the horizontal extending direction 20A and the axis 10A, and the included angle $\alpha 1$ is a right angle. A starting position of the horizontal extending direction 20A is connected to an ending position of the horizontal extending direction 20A, that is to say, the starting position is the ending position, and the ending position is the starting position. Forming of each of the convex portions 21 and each of the concave portions 22 in the horizontal extending direction 20A can be continuous or discontinuous (not shown in the figures).

Figure 3:
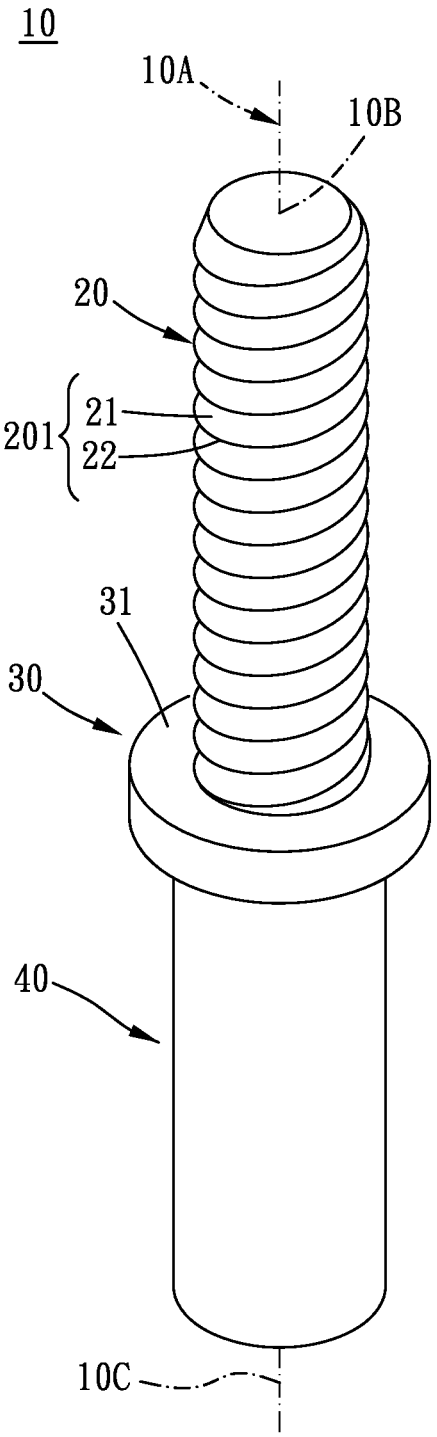
FIG. 3 is a second perspective view of the diameter-expanding tool head of the invention.

In the second forming mode (please refer to FIGS. 3 and 4), each of the convex portions 21 and each of the concave portions 22 are obliquely spirally disposed on the outer peripheral surface 201 of the expanding section 20 from the front end 10B toward the rear end 10C of the diameter-expanding tool head 10 to form an oblique extending direction 20B, the oblique extending direction 20B is parallel to the convex portions 21 and the concave portions 22 respectively, an included angle $\alpha 2$ is formed between the oblique extending direction 20B and the axis 10A, and the included angle $\alpha 2$ is a non-right angle (acute angle or obtuse angle). A starting position of the oblique extending direction 20B is not connected with an ending position of the oblique extending direction 20B, the starting position is located at or near the front end 10B, and the ending position is located at or near the rear end 10C. Forming of each of the convex portions 21 and each of the concave portions 22 in the oblique extending direction 20B can be continuous or discontinuous (not shown in the figures).

Continuing the description of the convex portions 21, each of the convex portions 21 has a convex peak 211, the convex peak 211 of each of the convex portions 21 is a part farthest from the axis 10A, each distance is equal (equal includes deformation, error or tolerance), a maximum outer diameter of the expanding section 20 is located at one part of the convex peak 211, and the maximum outer diameters are equal (equal includes deformation, error or tolerance). The convex peaks 211 are axially connected to one another relative to the axis 10A to form a diameter-expanding surface 23, and the diameter-expanding surface 23 spans each of the concave portions 22. The diameter-expanding surface 23 does not intersect with the axis 10A, the diameter-expanding surface 23 is parallel to the axis 10A, and the diameter-expanding surface 23 is also parallel to the outer peripheral surface 201.

Exteriors of the convex portions 21 and the concave portions 22 of the expanding section 20 mentioned in the first embodiment have the following three forms, but are not limited to these three forms.

In the first exterior form (please refer to FIG. 1), the convex portion 21 is an arcuate shape protruding outward relative to the axis 10A, the concave portion 22 is a V-shaped groove that is recessed inwardly relative to the axis 10A, two side walls of the concave portion 22 are arcuate shapes protruding outward opposite to each other, and bottom ends of the two side walls of the concave portion 22 are connected at an acute angle.

Figure 5:
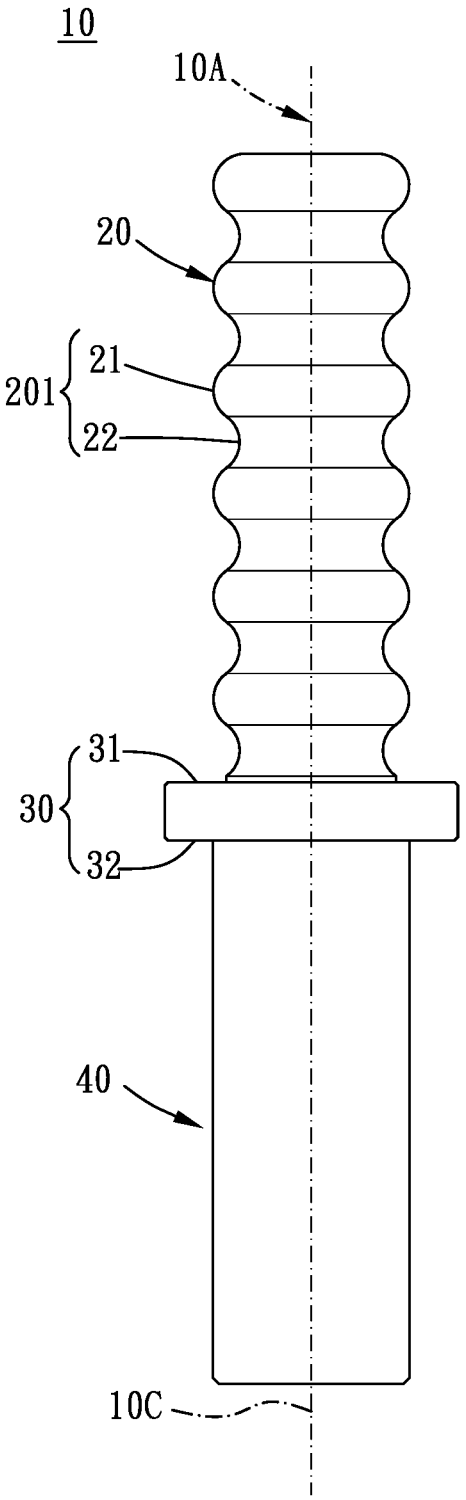
FIG. 5 is a plan view of convex portions and concave portions of the diameter-expanding tool head of the invention.

In the second exterior form (please refer to FIG. 5), the convex portion 21 is an arcuate shape protruding outward relative to the axis 10A, and the concave portion 22 is an arcuate shape that is recessed inwardly relative to the axis 10A.

Figure 6:
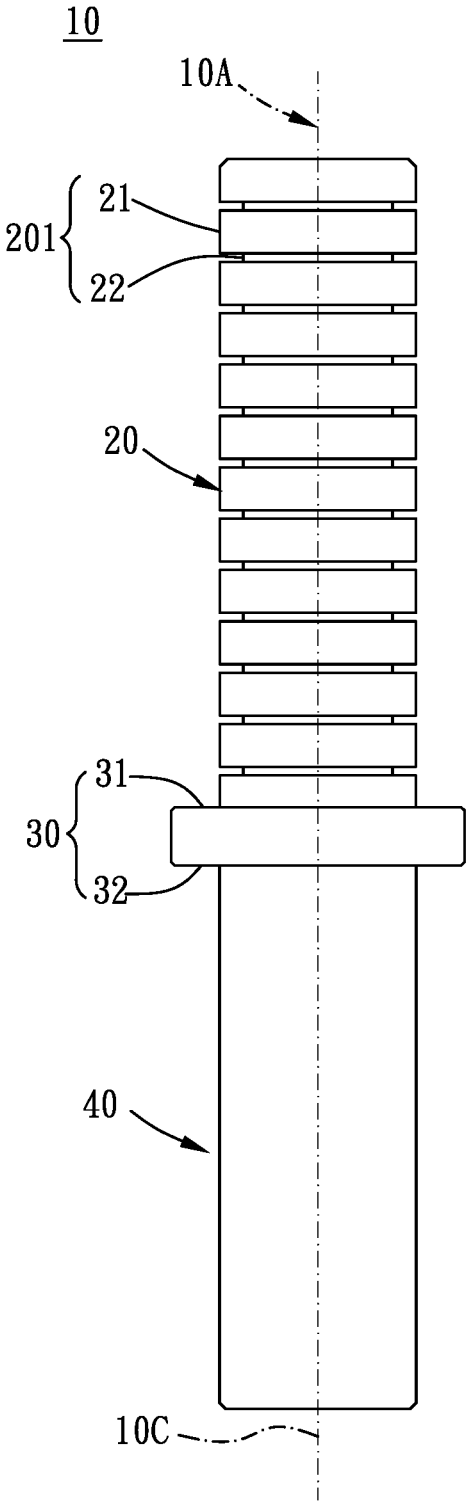
FIG. 6 is another plan view of the convex portions and the concave portions of the diameter-expanding tool head of the invention.

In the third exterior form (please refer to FIG. 6), the convex portion 21 is a plane relative to the axis 10A, the concave portion 22 is a U-shaped groove that is recessed inwardly relative to the axis 10A, a bottom side wall of the concave portion 22 is a plane, and the two side walls of the concave portion 22 are planes opposite each other.

Figure 7:
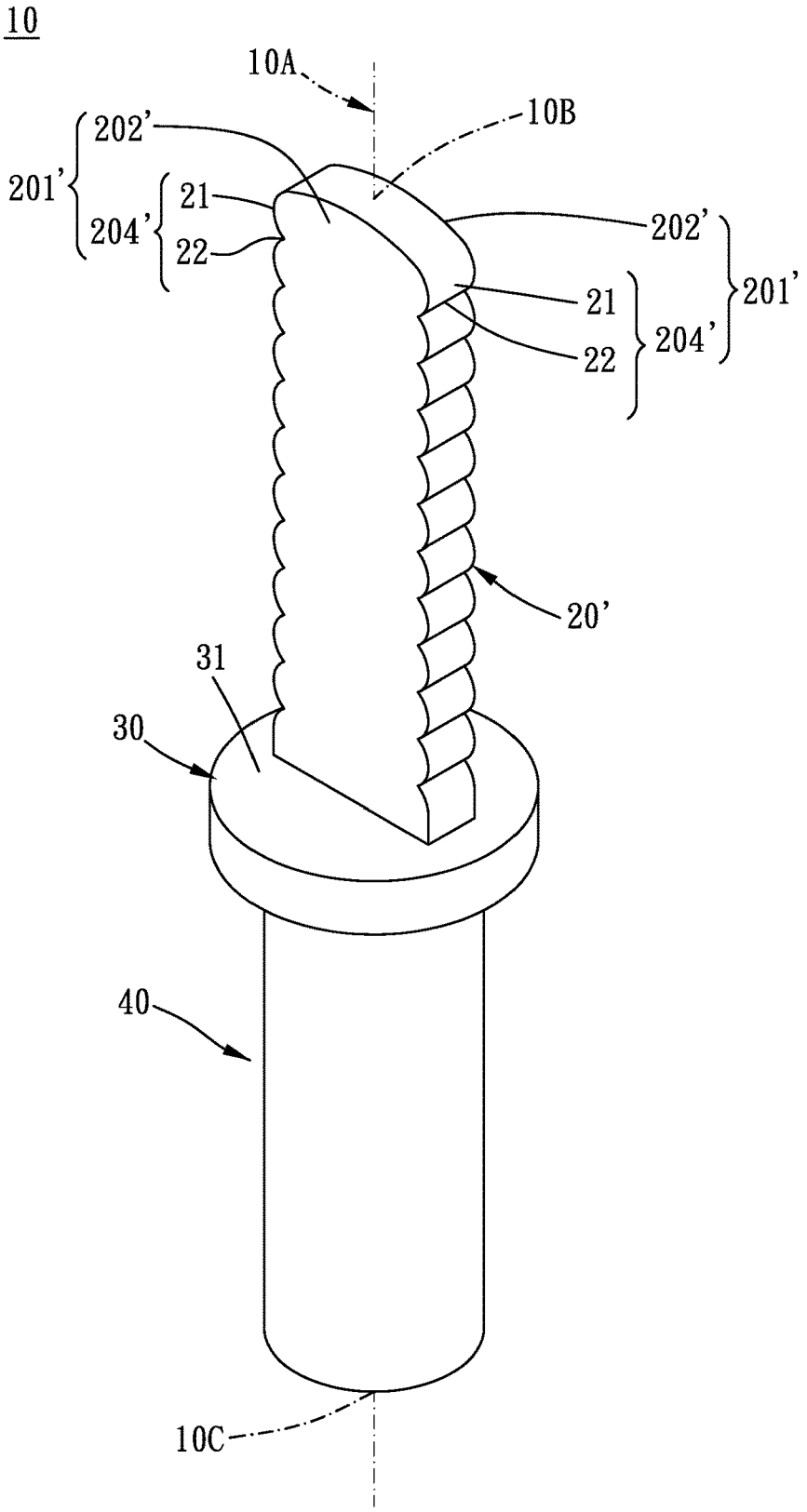
FIG. 7 is a perspective view of an outer peripheral surface of the diameter-expanding tool head of the invention.

Please refer to FIG. 7, the difference between the second embodiment and the first embodiment lies in the outer peripheral surfaces 201 and 201' (besides the difference of ' marked behind the numeral, the names and numerals of the components in the first embodiment will be used). The expanding section 20 of the second embodiment is a quadrangular column, the expanding section 20 is formed with the outer peripheral surface 201' relative to the axis 10A. The outer peripheral surface 201' is quadrangular columnar surfaces. The outer peripheral surface 201' is formed with two surfaces 202' opposite to each other, the two opposite surfaces 202' define two opposite side surfaces 204', and the expanding section 20 forms the convex portions 21 and the concave portions 22 at intervals on each of the side surfaces 204' relative to the axis 10A.

Each of the convex portions 21 and each of the concave portions 22 of the second embodiment have the following two forming modes, but are not limited to these two modes.

Please refer to FIGS. 2 and 7, in the first forming mode, each of the convex portions 21 and each of the concave portions 22 are horizontally disposed on the side surface 204' of the outer peripheral surface 201' of the expanding section 20 from the front end 10B toward the rear end 10C of the diameter-expanding tool head 10 to form the horizontal extending direction 20A, the included angle $\alpha 1$ is formed between the horizontal extending direction 20A and the axis 10A, and the included angle $\alpha 1$ is a right angle.

Figure 4:
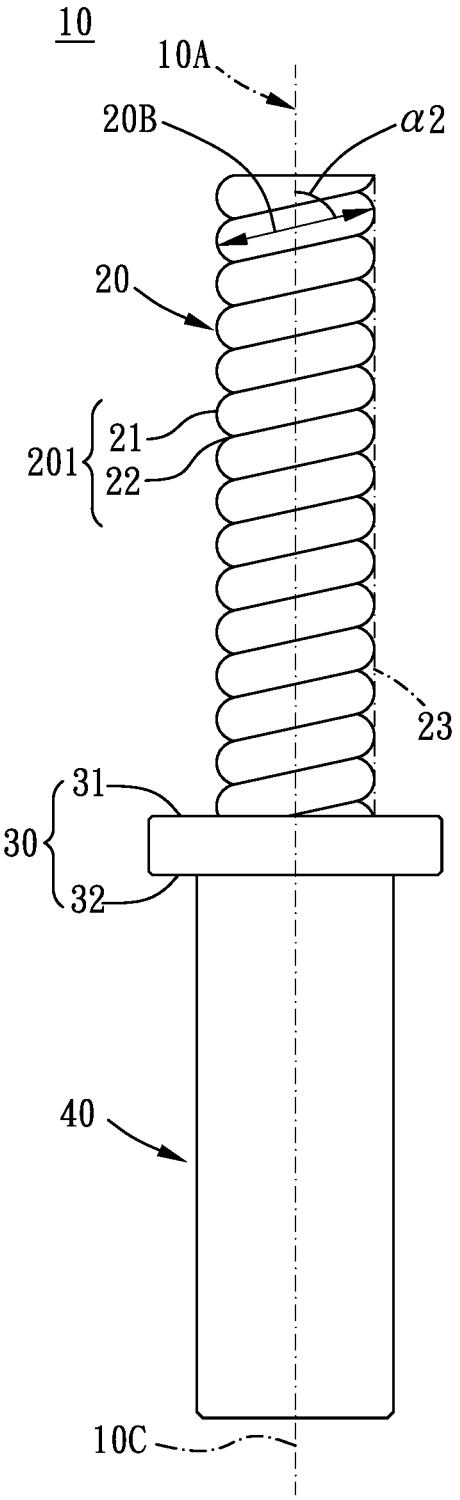
FIG. 4 is a plan view of the diameter-expanding tool head of FIG. 3 of the invention.

Please refer to FIGS. 4 and 7, in the second forming mode, each of the convex portions 21 and each of the concave portions 22 are obliquely disposed on the side surface 204' of the outer peripheral surface 201' of the expanding section 20 from the front end 10B toward the rear end 10C of the diameter-expanding tool head 10 to form the oblique extending direction 20B, the included angle $\alpha 2$ is formed between the oblique extending direction 20B and the axis 10A, and the included angle $\alpha 2$ is a non-right angle (acute angle or obtuse angle).

Because each of the convex portions 21 and each of the concave portions 22 of the second embodiment are only formed on the two opposite side surfaces 204', the starting position and the ending position cannot be used for further description. The horizontal extending direction 20A and the oblique extending direction 20B of the second embodiment are discontinuous.

The blocking section 30 is formed at the rear end 10C of the diameter-expanding tool head 10, the blocking section 30 is a cylinder, an outer diameter of the blocking section 30 is larger than a maximum outer diameter of the expanding section 20, and a blocking surface 31 is radially formed on one side surface of the blocking section 30 at a connection with the expanding section 20 relative to the axis 10A.

The diameter-expanding tool head 10 further comprises an assembling section 40 connected with the blocking section 30. The assembling section 40 and the blocking section 30 have the following two combination modes, but are not limited to these two modes.

Figure 10:
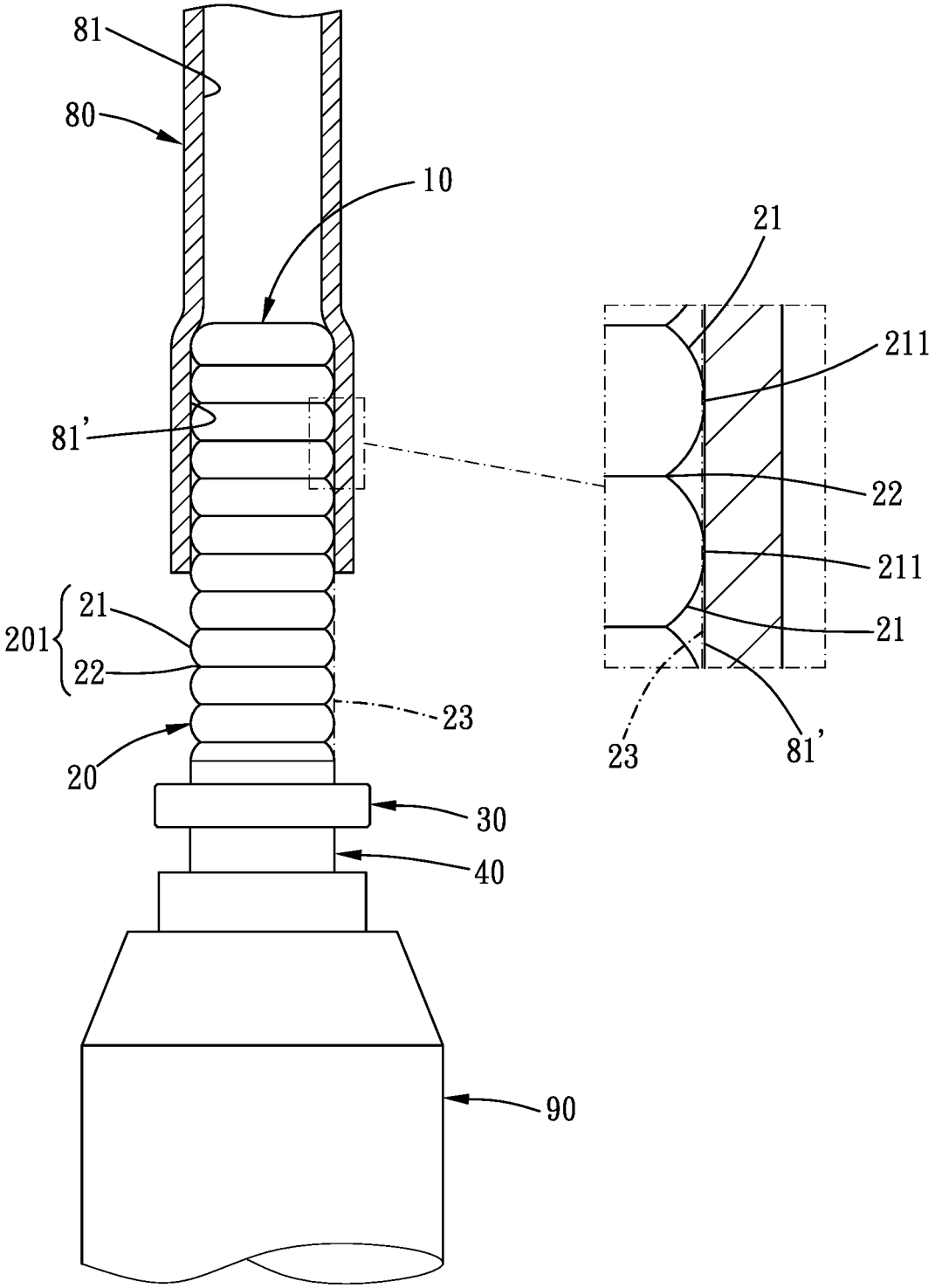
FIG. 10 is a combination diagram of the diameter-expanding tool head of the invention cooperating with a body to be expanded and a driving tool.

Please refer to FIG. 1 to FIG. 7, in the first combination mode, the assembling section 40 is integrally formed with the blocking section 30. The blocking section 30 is further formed with an assembling surface 32 on another side surface of the blocking section 30 opposite to the blocking surface 31, the assembling surface 32 is axially formed with the assembling section 40 relative to the axis 10A, and an outer diameter of the blocking section 30 is larger than an outer diameter of the assembling section 40. The rear end 10C of the diameter-expanding tool head 10 is located at the assembling section 40, and the assembling section 40 is a cylinder, a quadrangular column, a hexagonal column or a quincuncial column (not limited to the aforementioned types) used to be assembled to a driving tool 90 (please refer to FIG. 10). The driving tool 90 adopts electric or pneumatic driving. The driving tool 90 can provide a driven object with rotational motion or linear motion. The assembling section 40 of the diameter-expanding tool head 10 is driven by the driving tool 90 to move rotationally, so that the expanding section 20 can be rotationally inserted into a body 80 to be expanded to perform diameter-expanding until one end of the body 80 to be expanded is in contact with the blocking section 30, driving of the driving tool 90 can be stopped, and the diameter-expanding tool head 10 also stops rotating.

In the second combination mode, the assembling section 40 is combined with the blocking section 30, an outer diameter of the blocking section 30 is larger than an outer diameter of the assembling section 40. The blocking section 30 is further formed with the assembling surface 32 on another side surface of the blocking section 30 opposite to the blocking surface 31, the assembling surface 32 is axially formed with a blind hole (not shown in the figures) or a through hole (not shown in the figures) relative to the axis 10A, wherein the blind hole is concavely formed from the blocking section 30 toward the expanding section 20, and the through hole is formed from the blocking section 30 toward the expanding section 20 by penetrating through the diameter-expanding tool head 10. Inner shapes of the blind hole and the through hole correspond to a contour of the assembling section 40 (such as cylinder, quadrangular column, hexagonal column or quincuncial column, but are not limited to the aforementioned types), so that one end of the assembling section 40 is assembled with the blind hole or the through hole correspondingly, another end of the assembling section 40 is assembled with the driving tool 90, and the rear end 10C of the diameter-expanding tool head 10 is located at the assembling section 40.

Figure 8:
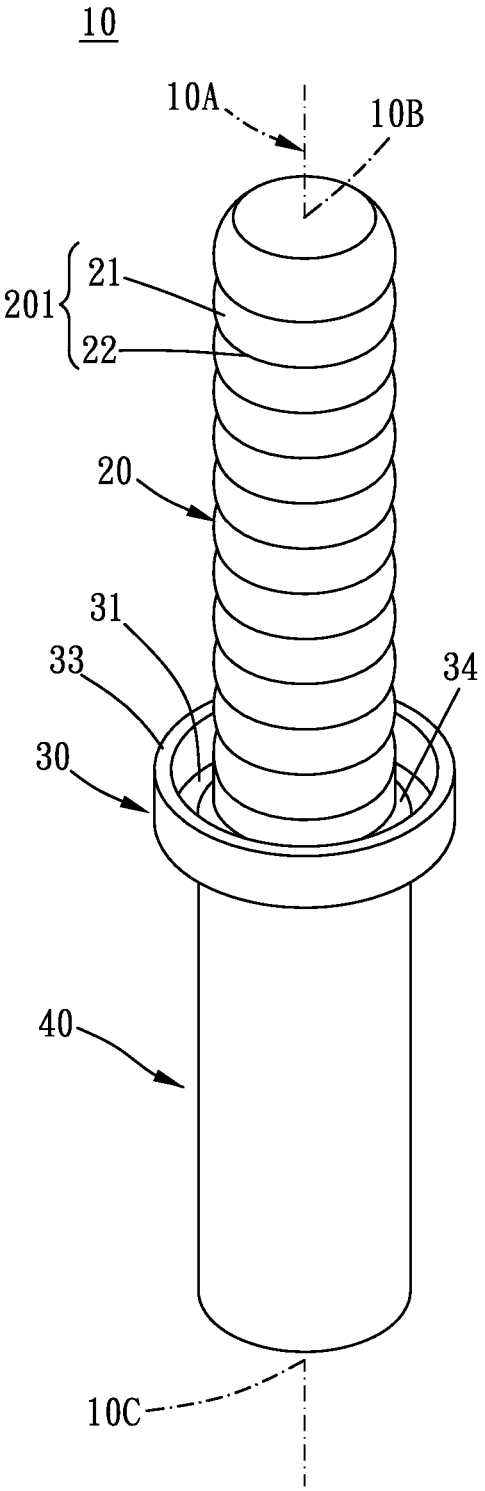
FIG. 8 is a perspective view of a blocking edge and an expanding cone of the diameter-expanding tool head of the invention.
Figure 9:
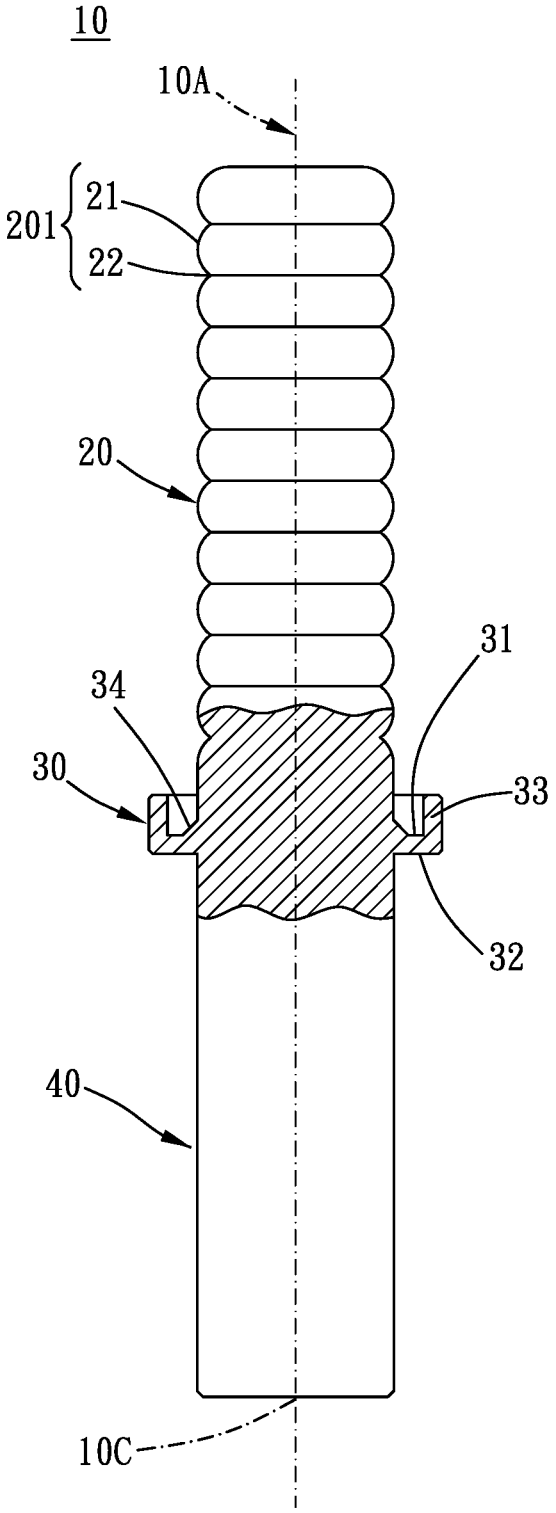
FIG. 9 is a plan view and a partial cross-sectional view of the diameter-expanding tool head of FIG. 8 of the invention.

Please refer to FIGS. 8 and 9, the blocking section 30 is further formed with a blocking edge 33, the blocking surface 31 of the blocking section 30 is axially formed with the blocking edge 33 at a peripheral edge relative to the axis 10A, and an inner wall surface of the blocking edge 33 is connected with the blocking surface 31.

Please refer to FIGS. 8 and 9, the blocking section 30 is further formed with an expanding cone 34, the blocking surface 31 is formed with the expanding cone 34 at a connection between the expanding section 20 and the blocking section 30, and the expanding cone 34 is capable of cooperating with the blocking edge 33. The expanding cone 34 expands outward in a tapering manner from the expanding section 20 toward the blocking section 30 from narrow to wide relative to the axis 10A, and preferably in a conical shape. The expanding cone 34 is formed with an outer peripheral surface relative to the axis 10A, and the outer peripheral surface is further formed with a plurality of convex portions (not shown in the figures) and a plurality of concave portions (not shown in the figures) at intervals. The convex and concave portions mentioned here have the same structures as those of the convex and concave portions 21, 22 mentioned in the first and second embodiments, which will not be repeated.

A diameter-expanding method of the diameter-expanding tool head 10 comprises: expanding a diameter of the body 80 to be expanded with a channel 81 by the diameter-expanding tool head 10 (please refer to FIG. 10), connecting the assembling section 40 of the diameter-expanding tool head 10 to the driving tool 90, driving the diameter-expanding tool head 10 to rotate by the driving tool 90, and inserting the expanding section 20 of the diameter-expanding tool head 10 rotatably into the channel 81 of the body 80 to be expanded, so that the expanding section 20 of the diameter-expanding tool head 10 is in discontinuous contact with the channel 81 of the body 80 to be expanded through the convex portions 21 and the concave portions 22.

The expanding section 20 is rubbed against an inner wall of the channel 81 by the convex peaks 211 of the convex portions 21 to shape the inner wall of the channel 81, and the concave portions 22 of the expanding section 20 are used to reduce a contact area between an outer wall of the expanding section 20 and the inner wall of the channel 81.

A diameter of at least a part of the body 80 to be expanded is expanded to form a diameter-expanded channel 81', and an inner wall surface of the diameter-expanded channel 81' is flush with the diameter-expanding surface 23 of the expanding section 20. Driving of the driving tool 90 can be stopped until one end of the body 80 to be expanded is in contact with the blocking surface 31 of the blocking section 30, and the diameter-expanding tool head 10 also stops rotating accordingly.

The diameter-expanding method of the diameter-expanding tool head 10 further comprises: one end of the body to be expanded 80 contacting with the blocking surface 31 first, continuing until one end of the body to be expanded 80 contacting with an inner wall surface of the blocking edge 33 of the blocking section 30, stopping driving of the driving tool 90, and stopping rotation of the diameter-expanding tool head 10 to prevent the body to be expanded 80 from being over-expanded or over-everted.

The diameter-expanding method of the diameter-expanding tool head 10 further comprises: before one end of the body to be expanded 80 contacting with the blocking surface 31, further expanding in diameter to form a bell mouth through the expanding cone 34, continuing until one end of the body to be expanded 80 contacting with an inner wall surface of the blocking edge 33 of the blocking section 30, stopping driving of the driving tool 90, and stopping rotation of the diameter-expanding tool head 10 to prevent the body to be expanded 80 from being over-expanded or over-everted.

However, if there is no blocking by the blocking edge 33, the following conditions will occur: one of the conditions is that one end of the body to be expanded 80 continues to expand in diameter along the blocking surface 31, and even covers the entire blocking section 30 to form over expansion, and finally an over-expanded structure can only be cut as waste. In another condition, one end of the body to be expanded 80 does not continue to expand in diameter along the blocking surface 31, but is over-everted in an opposite direction, and finally an entire rolled structure can only be cut as waste.

The assembling section 40 of the diameter-expanding tool head 10 is further replaced by the expanding section 20, which is different from that shown in FIG. 1 to FIG. 10. The diameter-expanding tool head 10 is provided with the blocking surface 31 on two sides of the blocking section 30 for forming the expanding section 20 (please refer to FIG. 11), the blocking section 30 is located between the two expanding sections 20. At this time, the front end 10B of the diameter-expanding tool head 10 is located at an end of one of the expanding sections 20 away from the blocking section 30, and the rear end 10C of the diameter-expanding tool head 10 is located at an end of the other expanding section 20 away from the blocking section 30. The expanding section 20 comprises the structures disclosed in FIG. 1 to FIG. 10, which will not be repeated herein. It is worth noting that maximum outer diameters of the two expanding sections 20 are the same or different from each other. The same state refers to a maximum outer diameter of one of the expanding sections 20 is equal to a maximum outer diameter of the other expanding section 20, and the different state refers to a maximum outer diameter of one of the expanding sections 20 is greater than or smaller than a maximum outer diameter of the other expanding section 20. In this way, the two ends of the diameter-expanding tool head 10 is capable of expanding a diameter of at least a part of the body 80 to be expanded and forming the diameter-expanded channel 81'.

The two ends of the diameter-expanding tool head 10 further comprise the assembling section 40 connected with the expanding section 20. Combination between the assembling section 40 and the expanding section 20 has following two modes, but is not limited to the two modes.

Figure 11:
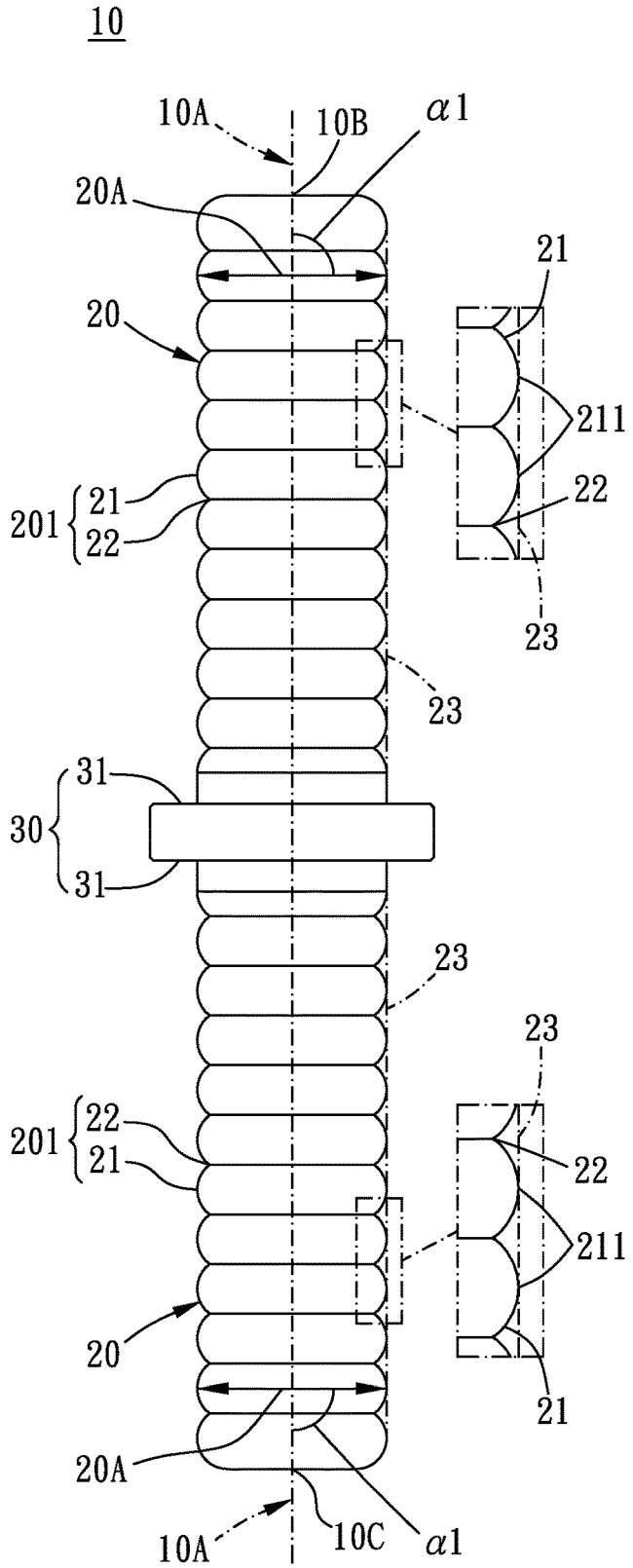
FIG. 11 is a plan view of two sides of a blocking section of the diameter-expanding tool head of the invention respectively matching with an expanding section.
Figure 12:
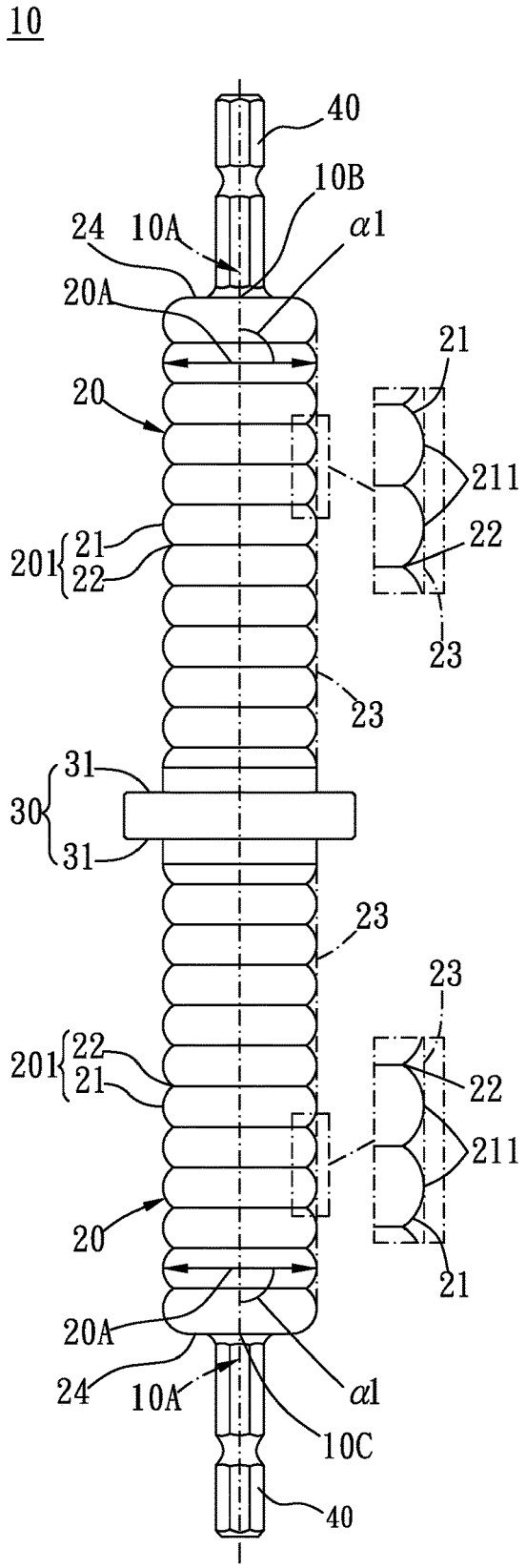
FIG. 12 is a first plan view of the expanding section matching with an assembling section of the diameter-expanding tool head in FIG. 11 of the invention.

Please refer to FIG. 12, the two ends of the diameter-expanding tool head 10 disclosed in FIG. 11 further comprise the assembling section 40 connected with the expanding section 20, one end of the expanding section 20 is further formed with an assembling surface 24, and the assembling surface 24 forms the assembling section 40 axially corresponding to the axis 10A. At this time, the front end 10B and the rear end 10C of the diameter-expanding tool head 10 are respectively located at two ends of the assembling sections 40. The assembling section 40 of the diameter-expanding tool head 10 is connected to the driving tool 90. In addition, the diameter-expanding tool head 10 disclosed in FIG. 12 is also applicable to having the expanding section 20 provided at only one of the ends of the diameter-expanding tool head 10, and is not limited to each of the two ends having the expanding section 20.

Figure 13:
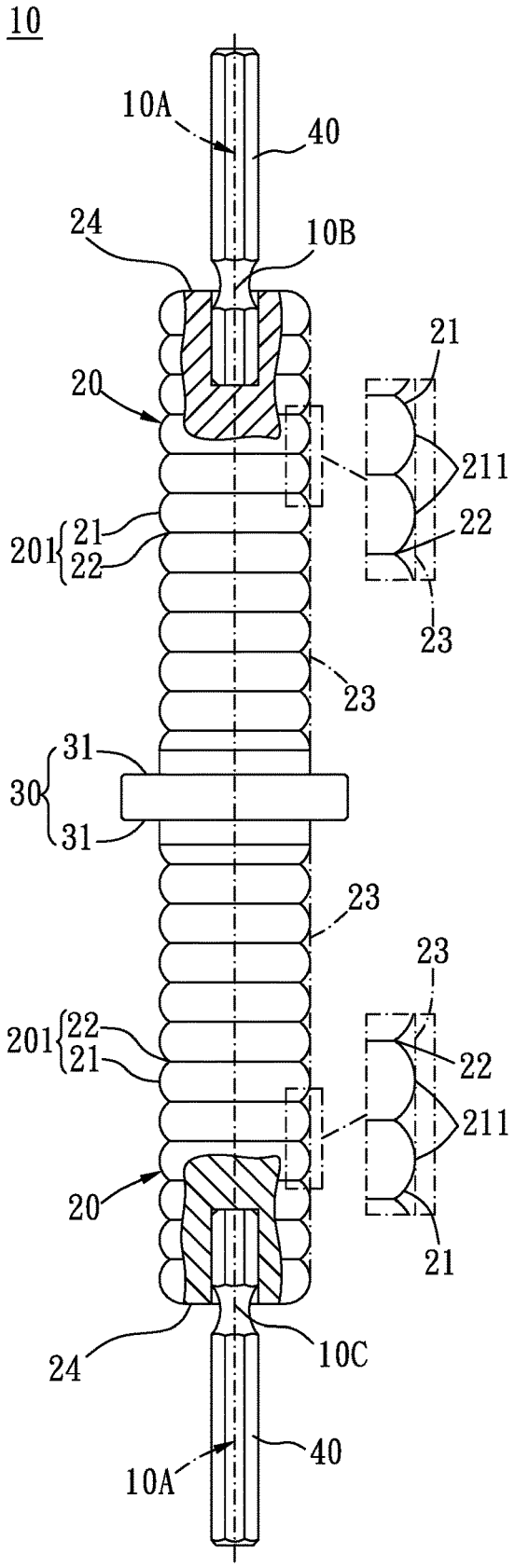
FIG. 13 is a second plan view of the expanding section matching with the assembling section of the diameter-expanding tool head in FIG. 11 of the invention.

Please refer to FIG. 13, end portions of the expanding sections 20 at the two ends of the diameter-expanding tool head 10 disclosed in FIG. 11 are further formed with the assembling surface 24 respectively, the assembling surface 24 is axially formed with a blind hole (please refer to FIG. 13) or a through hole (not shown in the figures) corresponding to the axis 10A, the blind hole is formed by recessing from the expanding section 20 towards the blocking section 30, and the through hole is formed by piercing the diameter-expanding tool head 10 from the expanding section 20 towards the blocking section 30. The two ends of the diameter-expanding tool head 10 further comprise the assembling section 40 connected to the expanding section 20. Inner shapes of the blind hole and the through hole correspond to a contour of the assembling section 40. One end of the assembling section 40 is assembled with the blind hole or the through hole correspondingly, at this time, the front end 10B and the rear end 10C of the diameter-expanding tool head 10 are respectively located at the two ends of the assembling sections 40. Moreover, the expanding section 20 at one of the ends of the diameter-expanding tool head 10 can cooperate with the assembling section 40 disclosed in FIG. 12, and the expanding section 20 at the other end of the diameter-expanding tool head 10 can cooperate with the assembling section 40 disclosed in FIG. 13. The assembling section 40 of the diameter-expanding tool head 10 is connected to the driving tool 90. In addition, the diameter-expanding tool head 10 disclosed in FIG. 13 is also applicable to having the expanding section 20 provided at only one of the ends of the diameter-expanding tool head 10, and is not limited to each of the two ends having the expanding section 20.

The expanding section 20 of the diameter-expanding tool head 10 of the invention is in discontinuous contact with the channel 81 of the body 80 to be expanded through the convex portions 21 and the concave portions 22 to perform diameter expansion. Thereby, a contact area between the diameter-expanding tool head 10 and the body 80 to be expanded is reduced, a load of the diameter-expanding tool head 10 is reduced, heat accumulated in a friction process is reduced, a speed of temperature rise caused by heat is slowed down, and a service life is prevented from being affected by material strength.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the embodiments.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A diameter-expanding tool head, the diameter-expanding tool head defining an axis, the diameter-expanding tool head defining a front end and a rear end relative to the axis, the diameter-expanding tool head comprising:

an expanding section, the expanding section being formed from the front end toward the rear end relative to the axis, the expanding section being cylindrical, the expanding section being formed with an outer peripheral surface relative to the axis, the outer peripheral surface being a cylindrical surface, the outer peripheral surface being formed with a plurality of convex portions and a plurality of concave portions disposed at intervals, any one of the concave portions being formed between any two of the convex portions, each of the convex portions being an arcuate shape protruding outward relative to the axis, each of the convex portions having a convex peak, the convex peak of each of the convex portions being a part farthest from the axis, each distance being equal, a maximum outer diameter of the expanding section being located at any one of the convex peaks, the convex peak of each of the convex portions being axially connected relative to the axis to form a diameter-expanding surface, the diameter-expanding surface spanning each of the concave portions; and a blocking section connected to the expanding section, the blocking section being formed on the rear end relative to the axis, an outer diameter of the blocking section being larger than the maximum outer diameter of the expanding section, and a connection between one side surface of the blocking section and the expanding section radially forming a blocking surface relative to the axis.

2. The diameter-expanding tool head as claimed in claim 1, wherein any one of the convex portions and any one of the concave portions are horizontally annularly disposed on the outer peripheral surface of the expanding section from the front end to the rear end of the diameter-expanding tool head to form a horizontal extending direction, the horizontal extending direction is parallel to the convex portions and the concave portions respectively, an included angle is formed between the horizontal extending direction and the axis, the included angle is a right angle, a starting position of the horizontal extending direction is connected to an ending position of the horizontal extending direction, forming of any one of the convex portions and any one of the concave portions in the horizontal extending direction is continuous or discontinuous.

3. The diameter-expanding tool head as claimed in claim 1, wherein any one of the convex portions and any one of the concave portions are obliquely spirally disposed on the outer peripheral surface of the expanding section from the front end to the rear end of the diameter-expanding tool head to form an oblique extending direction, the oblique extending direction is parallel to the convex portions and the concave portions respectively, an included angle is formed between the oblique extending direction and the axis, the included angle is a non-right angle, a starting position of the oblique extending direction is not connected with an ending position of the oblique extending direction, the starting position is located at or near the front end, and the ending position is located at or near the rear end, forming of any one of the convex portions and any one of the concave portions in the oblique extending direction is continuous or discontinuous.

4. The diameter-expanding tool head as claimed in claim 1, wherein the convex portions do not intersect with one another and are parallel to one another, the concave portions do not intersect with one another and are parallel to one another, any one of the convex portions and any one of the concave portions do not intersect with each other and are parallel to each other, the maximum outer diameters are equal, the diameter-expanding surface does not intersect with the axis, the diameter-expanding surface is parallel to the axis, and the diameter-expanding surface is parallel to the outer peripheral surface.

5. The diameter-expanding tool head as claimed in claim 1, further comprising an assembling section connected with the blocking section, wherein the blocking section is formed with an assembling surface on another side surface of the blocking section opposite to the blocking surface, wherein the assembling section extends axially from the assembling surface relative to the axis, wherein an outer diameter of the blocking section is larger than an outer diameter of the assembling section, and wherein an end of the assembling section opposite to the blocking section defines the rear end of the diameter-expanding tool head.

6. The diameter-expanding tool head as claimed in claim 1, wherein the blocking section is further formed with a blocking edge, the blocking surface of the blocking section is axially formed with the blocking edge at a peripheral edge relative to the axis.

* * * * *